US010334942B2

(12) United States Patent
Newton

(10) Patent No.: US 10,334,942 B2
(45) Date of Patent: Jul. 2, 2019

(54) SOAP DISPENSING BRUSH

(71) Applicant: Donald Newton, Richmond, VA (US)

(72) Inventor: Donald Newton, Richmond, VA (US)

( * ) Notice: Subject to any disclaimer, the term of this patent is extended or adjusted under 35 U.S.C. 154(b) by 90 days.

(21) Appl. No.: 15/253,351

(22) Filed: Aug. 31, 2016

(65) Prior Publication Data

US 2017/0055691 A1 Mar. 2, 2017

Related U.S. Application Data

(60) Provisional application No. 62/212,079, filed on Aug. 31, 2015.

(51) Int. Cl.
*A47K 7/02* (2006.01)
*A46B 11/00* (2006.01)

(52) U.S. Cl.
CPC ..... *A46B 11/002* (2013.01); *A47K 7/028* (2013.01); *A46B 11/0062* (2013.01); *A46B 2200/1006* (2013.01)

(58) Field of Classification Search
CPC ..... A46B 9/06; A46B 11/002; A46B 11/0062; A46B 11/0013; A46B 2200/1003; A46B 2200/102; A46B 2200/3033; A47K 7/028; A47K 7/03
See application file for complete search history.

(56) References Cited

U.S. PATENT DOCUMENTS 1,425,242 A * 8/1922 Dinardo ..... A46B 11/0013 401/185
1,733,144 A * 10/1929 Walker ..... A46B 11/0013 15/184
2,952,026 A * 9/1960 La Pland ..... A46B 11/0013 222/508
3,256,894 A * 6/1966 Sherman ..... A46B 11/0055 222/209
4,961,661 A 10/1990 Sutton et al.
D334,665 S 4/1993 Johnson
5,320,125 A * 6/1994 Barnhart ..... A45D 40/18 132/297
6,250,833 B1 * 6/2001 Perry ..... A46B 11/0013 401/206
6,623,201 B2 * 9/2003 Brumlik ..... A46B 11/0013 401/270
8,360,668 B1 1/2013 Hinnant
8,672,573 B2 3/2014 Francoeur
2006/0168746 A1 8/2006 Guyuron et al.
2009/0188528 A1 * 7/2009 Junkins ..... A46B 5/0095 134/6

* cited by examiner

*Primary Examiner* — David P Angwin
*Assistant Examiner* — Bradley S Oliver
(74) *Attorney, Agent, or Firm* — Global Intellectual Property Agency, LLC; Daniel Boudwin

(57) ABSTRACT

A soap dispensing brush. The soap dispensing brush includes a handle having a first end, a second end, and an interior volume configured to store liquid cleaner therein. A depressible end cap is removably secured to the second end of the handle. A brush head is disposed on the first end of the handle, the brush head comprising a first side and a second side, the first side having a plurality of bristles thereon. A plurality of apertures are disposed on the first side of the brush. A push rod is disposed within the interior volume and is communication with the end cap and with a valve. The valve is configured to open when the end cap is depressed, and opening of the valve dispenses liquid from the plurality of apertures.

12 Claims, 3 Drawing Sheets

SOAP DISPENSING BRUSH

CROSS REFERENCE TO RELATED APPLICATIONS

This application claims the benefit of U.S. Provisional Application No. 62/212,079 filed on Aug. 31, 2015. The above identified patent application is herein incorporated by reference in its entirety to provide continuity of disclosure.

FIELD OF THE INVENTION

The present invention relates to self-cleaning devices. More specifically, the present invention provides a soap dispensing brush for cleaning an individual, wherein the soap dispensing brush stores liquid soap until it is released by the user during cleaning.

BACKGROUND OF THE INVENTION

Many individuals rely on sponges or other scrubbing brushes to clean the body. It can be difficult to reach the back and other areas for cleaning purposes, particularly for elderly or inflexible individuals. As such, some individuals neglect washing the back and other difficult to reach areas. Devices such as typical elongated scrub brushes allow individuals to reach difficult to access areas with a cleaning implement, but such devices fail to provide a means for transporting soap or cleaning solution to the same area. It is often difficult to accrue enough soap or lather on the brush or sponge in order to effectively clean the desired area. In light of these concerns, there is a need for an improved scrubbing brush having a soap dispensing mechanism for cleaning difficult to reach areas of the body.

Devices have been disclosed in the art relating to cleaning brushes. These include devices that have been patented and published in patent application publications. These devices generally relate to personal cleaning devices, such as U.S. Published Patent Application Number 2006/0168746, U.S. Pat. Nos. D334,665, 8,672,573, 8,360,668, and 4,961,661.

These prior art devices have several known drawbacks. The prior art devices fail to provide a brush having different types of bristles on one side and a mirror on an opposing side. Further, the prior art devices fail to provide a dispensing brush wherein liquid is dispensed via a push rod system disposed within the reservoir. The prior art devices further fail to provide a seal that prevents liquid from being dispensed unless acted upon by the push rod.

In light of the devices disclosed in the prior art, it is submitted that the present invention substantially diverges in design elements from the prior art and consequently it is clear that there is a need in the art for an improvement to existing animal deterring devices. In this regard the present invention substantially fulfills these needs.

SUMMARY OF THE INVENTION

In view of the foregoing disadvantages inherent in the known types of personal cleaning devices now present in the prior art, the present invention provides a soap dispensing brush wherein the same can be utilized for providing convenience for the user when cleaning difficult to reach areas of the body. The soap dispensing brush comprises a handle having a first end, a second end, and an interior volume configured to store liquid cleaner therein. A depressible end cap is removably secured to the second end of the handle. A brush head is disposed on the first end of the handle, the brush head comprising a first side and a second side, the first side having a plurality of bristles thereon. A plurality of apertures are disposed on the first side of the brush. A push rod is disposed within the interior volume and is communication with the end cap and with a valve. The valve is configured to open when the end cap is depressed, and opening of the valve dispenses liquid from the plurality of apertures.

One object of the present invention is to provide a soap dispensing brush having all the advantages of the prior art devices and none of the disadvantages.

Another object of the present invention is to provide a soap dispensing brush having a first group of bristles disposed around a second group of bristles for different cleaning properties.

A further object of the present invention is to provide a soap dispensing brush having a Other objects, features, and advantages of the present invention will be apparent from the following detailed description taken in conjunction with the drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
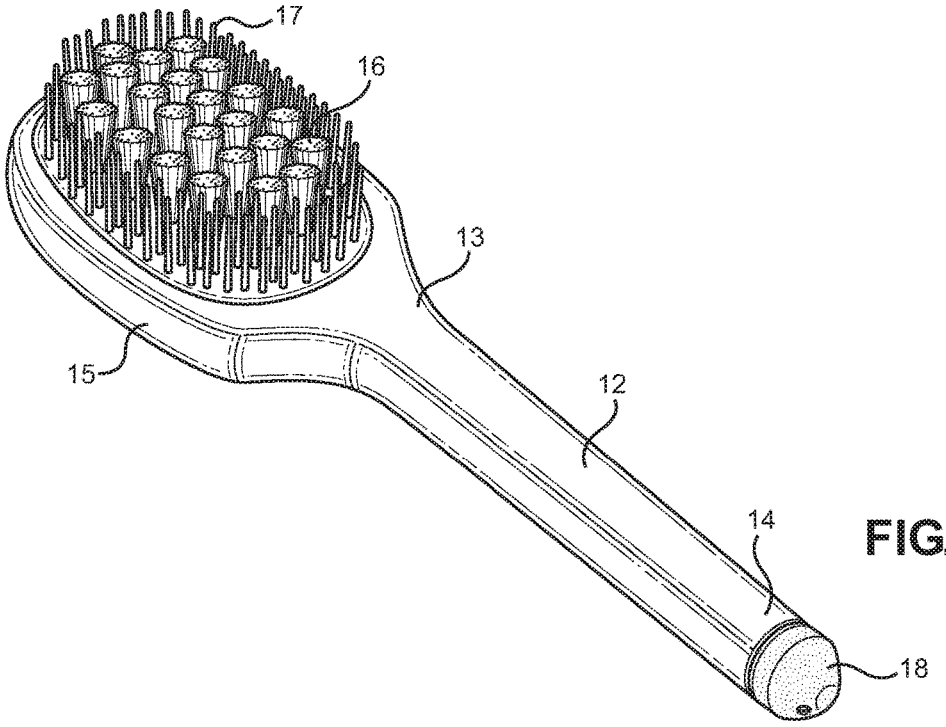
FIG. 1A shows a front perspective view of a soap dispensing brush according to the present invention.

Reference is made herein to the attached drawings. Like reference numerals are used throughout the drawings to depict like or similar elements of the soap dispensing brush. For the purposes of presenting a brief and clear description of the present invention, the preferred embodiment will be discussed as used for cleaning the body of the user while simultaneously dispensing liquid soap. The figures are intended for representative purposes only and should not be considered to be limiting in any respect.

Figure 1B:
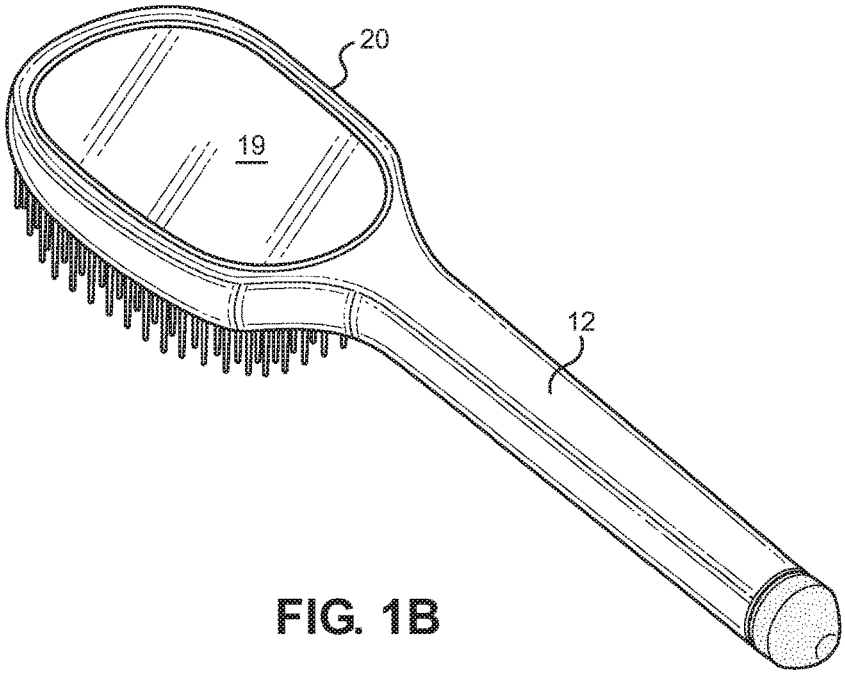
FIG. 1B shows a rear perspective view of a soap dispensing brush according to the present invention.

Referring now to FIGS. 1A-1B, there is shown a perspective view and a bottom perspective view of a soap dispensing brush according to the present invention. The soap dispensing brush generally comprises a handle 12 having a first end 13 and a second end 14. A brush head 15 is disposed on the first end 13 of the handle 12. The handle 12 may have a grip thereon for helping a user grip the soap dispensing brush. An end cap 18 is disposed on the second end 14 of the handle 12 and is removably secured thereto. The end cap 18 is depressible such that depressing the end cap 18 dispenses liquid soap out of the brush head 15.

The brush head 15 includes a plurality of bristles thereon. In the illustrated embodiment, the plurality of bristles includes a first group of bristles 16 disposed on a central portion of a first side of the brush head 15. A second group of bristles 17 encircles the first group of bristles 16. The first group of bristles 16 are larger in size than the second group of bristles 17 so that each may provide different cleaning properties.

A mirror 19 is disposed on a second side of the brush head 5. The mirror 19 allows individuals to observe areas they would not be able to see so that they may effectively clean those areas. The mirror 19 preferably extends to the perimeter 20 of the brush head. The handle 12 is also longer in length than the brush head 15 so that a sufficient amount of leverage may be applied to the brush head 15 via the handle 12 to achieve proper pressure for removing dirt from the user.

Figure 2:
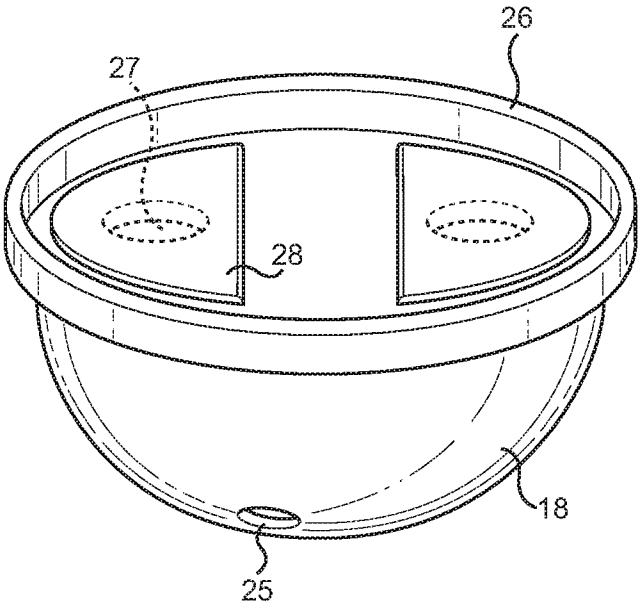
FIG. 2 shows a perspective view of the underside of the cap portion of a soap dispensing brush according to the present invention.

Referring now to FIG. 2, there is shown a perspective view of the underside of the end cap portion of a soap dispensing brush according to the present invention. The end cap 18 comprises a retaining ring 26 that secures the end cap 18 to the handle. A vent hole 25 is disposed on the surface of the end cap 18 and allows air to enter the hollow interior portion of the end cap 18. A flap 28 covers an inner air vent 27 disposed on the underside of the end cap 18. The end cap 18 is depressed, the flaps 28 open and allow the air from the inner portion of the end cap 18 to exit the end cap 18 via the inner air vents 27. The illustrated embodiment includes one vent hole and two inner air vents 27, each having their own flap 28, but another number of vent holes or air vents may be utilized in order to achieve optimal dispensing of the liquid soap.

Figure 3:
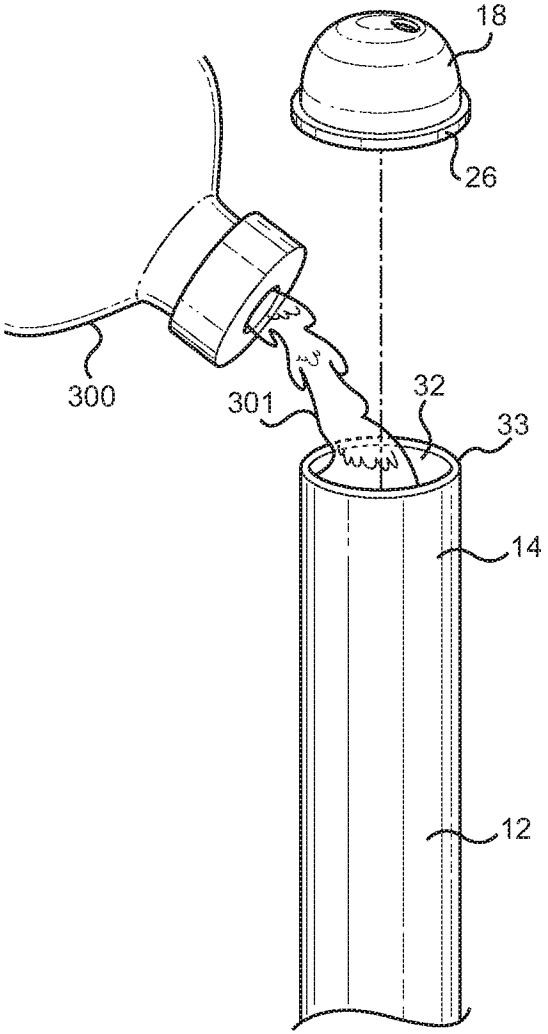
FIG. 3 shows a perspective view of liquid soap being inserted into the handle portion of a soap dispensing brush according to the present invention.

Referring now to FIG. 3, there is shown a perspective view of liquid soap being inserted into the handle portion of a soap dispensing brush according to the present invention. A bottle 300 of liquid soap 301 is shown being poured into the interior volume 32 of the handle 12. Any appropriate liquid cleaning soap 301 may be utilized, but preferably a liquid soap adapted for cleaning the human body. After filling the interior volume 32 with liquid soap 301, the user may reattach the end cap 18 to the handle 12. The retaining ring 26 of the end cap 18 engages the upper edge 33 of the second end 14 of the handle 12 and is secured thereto via a friction fit between the retaining ring 26 and the upper edge 33. In an alternate embodiment, the upper edge 33 comprises threads thereon that mesh with threads on the retaining ring 26, allowing the end cap 18 to be removably secured to the handle 12 via a threaded connection.

Figure 4:
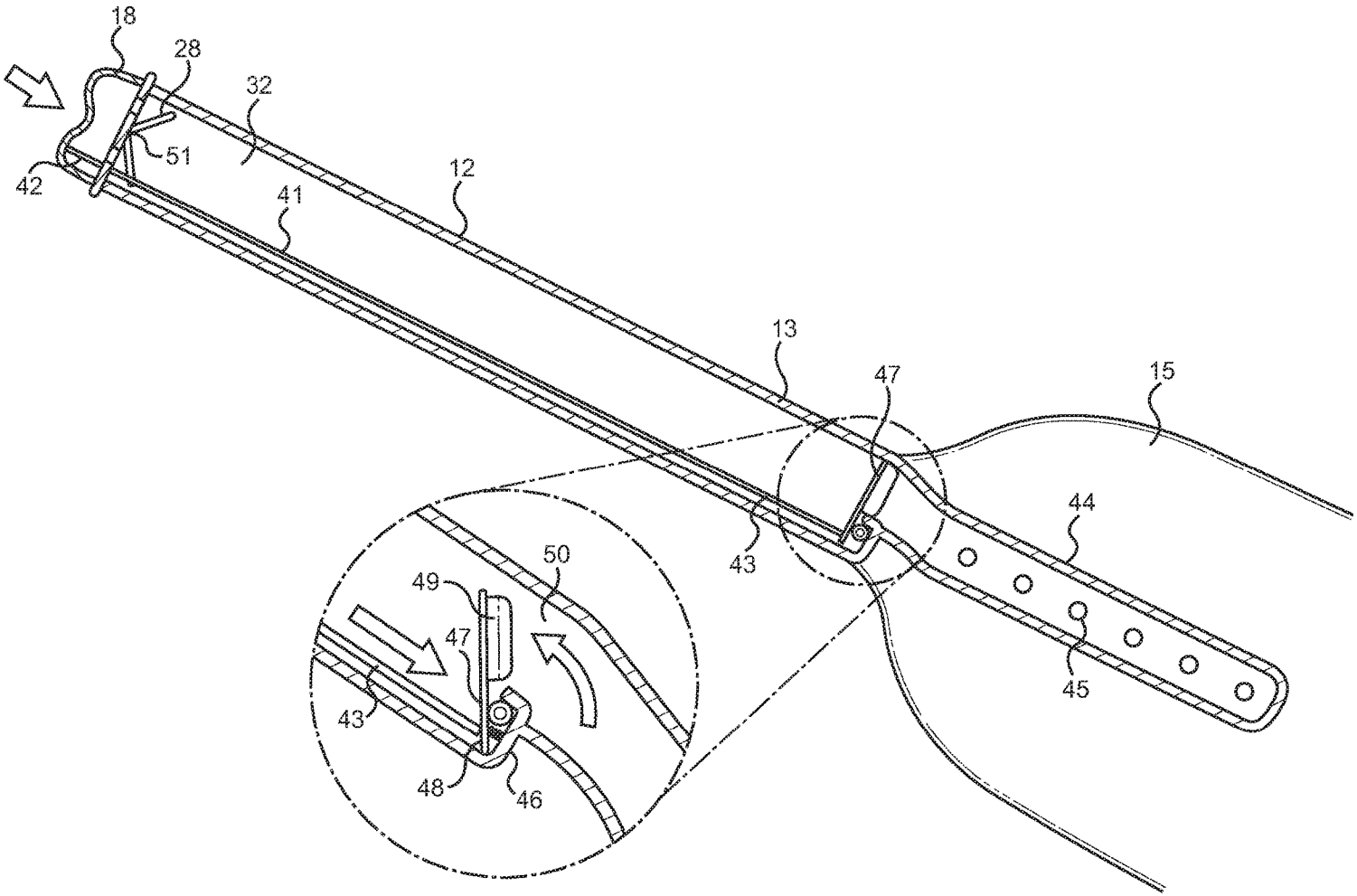
FIG. 4 shows a cross-sectional view of a soap dispensing brush according to the present invention.

Referring now to FIG. 4, there is shown a cross-sectional view of a soap dispensing brush according to the present invention. A dispenser 44 having a plurality of apertures 45 is disposed on the first side of the brush head 15. The plurality of apertures 45 dispense liquid soap therefrom and are preferably arranged in a linear pattern wherein each individual aperture 45 is equidistant from an adjacent individual aperture 45 so that liquid soap is dispensed uniformly onto the bristles (not shown).

The interior volume 32 of the handle 12 comprises a push rod 41 disposed therein. A first end 42 push rod 41 is in contact with the inner side of the end cap 18. A second end 43 of the push rod 41 is in contact with a valve 47, wherein the valve is situated at the first end 13 of the handle 12. The valve 47 has a seal 49 thereon and is spring biased toward a closed position via a spring 46. When the valve 47 is closed, the seal 49 prevents liquid soap from exiting the interior volume 23 through the valve opening 50.

When the end cap 18 is depressed, flaps 28 open via a hinge 51 which allows air to enter the interior volume 23 of the handle. Depressing the end cap 18 further causes the push rod 43 to contact a lever 48 disposed on the valve 47. The push rod 43 pressing against the lever 48 causes the valve 47 to open. Air pressure then forces the liquid stored within the interior volume 23 through the open valve 47 and out of the apertures 45. The dispensed liquid is then contained by the bristles on the brush head 15. Users may then apply the liquid soap to the area of the body to be cleaned. Users may repeatedly depress the end cap 18 in order to release additional amounts of liquid soap from the apertures 45. In this way, users have the ability to apply a constant supply of liquid soap while simultaneously cleaning difficult to reach areas.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soap dispensing brush, comprising:

a handle having a first end, a second end, and an interior volume configured to store liquid cleaner therein;

an end cap removably secured to the second end of the handle;

wherein the end cap comprises at least one exterior air vent in fluid communication with at least one interior opening disposed on the end cap;

wherein at least one flap is hingedly affixed to the end cap, the flap configured to selectively move between a closed position and an open position when the end cap is depressed, wherein the flap covers the interior opening when in the closed position;

a brush head disposed on the first end of the handle, the brush head comprising a first side and a second side, the first side having a plurality of bristles thereon;

a plurality of apertures disposed on the first side of the brush;

a push rod having a first end in contact with the end cap and a second end in contact with a valve;

wherein the valve is configured to open when the end cap is depressed;

and whereby opening of the valve dispenses liquid from the plurality of apertures.

2. The soap dispensing brush of claim 1, further comprising a mirror disposed on the second side of the brush head.

3. The soap dispensing brush of claim 2, wherein a perimeter of the mirror is aligned with a perimeter of the brush head.

4. The soap dispensing brush of claim 1, wherein the plurality of bristles comprises a first group of bristles and a second group of bristles, wherein the second group of bristles is arranged concentrically around the first group of bristles.

5. The soap dispensing brush of claim 4, wherein one of the first group of bristles has a diameter that is less than a diameter of one of the second group of bristles.

6. The soap dispensing brush of claim 1, wherein the plurality of apertures are arranged in a linear patter.

7. The soap dispensing brush of claim 6, wherein each aperture of the plurality of apertures is spaced equidistant from one at least one adjacent aperture.

8. The soap dispensing brush of claim 1, wherein the valve comprises a seal thereon, and further comprises a spring that maintains the valve in a default closed position, wherein the seal is configured to prevent liquid from being dispensed from the plurality of apertures when the valve is in the default closed position.

9. The soap dispensing brush of claim 8, wherein the seal extends into an opening between the interior volume of the handle and the plurality of apertures when the valve is in the closed position.

10. The soap dispensing brush of claim 1, wherein the end cap is removably secured to the second end of the handle via friction fit therewith.

11. The soap dispensing brush of claim 1, wherein the end cap is removably secured to the second end of the handle via a threaded connection therewith.

12. The soap dispensing brush of claim 1, wherein the end cap deforms when depressed towards the first end of the handle.

* * * * *